United States Patent [19]

Weiss et al.

[11] Patent Number: 4,557,057

[45] Date of Patent: Dec. 10, 1985

[54] APPARATUS FOR THE DRYING OF TOBACCO MATERIALS

[75] Inventors: Arno Weiss, Delingsdorf; Horst Gaisser, Hassloch, both of Fed. Rep. of Germany

[73] Assignee: B.A.T. Cigaretten-Fabriken GmbH, Hamburg, Fed. Rep. of Germany

[21] Appl. No.: 577,930

[22] Filed: Feb. 7, 1984

[30] Foreign Application Priority Data

Feb. 18, 1983 [DE] Fed. Rep. of Germany ..... 3305670

[51] Int. Cl.[4] ..... F26B 17/10

[52] U.S. Cl. ..... 34/48; 34/54; 34/57 R; 131/303; 131/304

[58] Field of Search ..... 34/46, 54, 48, 57 R; 131/302, 303, 304

[56] References Cited

U.S. PATENT DOCUMENTS

| | | | |
|---|---|---|---|
| 1,550,422 | 8/1925 | Braemer | 34/46 |
| 3,357,436 | 12/1967 | Wright | 34/46 |

FOREIGN PATENT DOCUMENTS

| | | | |
|---|---|---|---|
| 2841874 | 9/1978 | Fed. Rep. of Germany . | |
| 3114712 | 4/1981 | Fed. Rep. of Germany . | |
| 2004999 | 4/1979 | United Kingdom | 34/46 |
| 2083600 | 3/1982 | United Kingdom . | |

*Primary Examiner*—Larry I. Schwartz

*Attorney, Agent, or Firm*—Armstrong, Nikaido, Marmelstein & Kubovcik

[57] ABSTRACT

A stream dryer comprises in addition to the control bypass which bypasses the heat source a second ready-use bypass which is in parallel with the control bypass and bypasses the heat source. In the event of short-duration interruptions in working, the supply of steam is interrupted and the circulation of the hot gas is maintained substantially only through the ready-use bypass, so that the temperature of the circulated hot gas substantially does not change when the relatively small heat losses due to surface and exhaust gas losses are compensated. Temperature regulation is effected through the agency of the control bypass in this state of readiness also.

15 Claims, 1 Drawing Figure

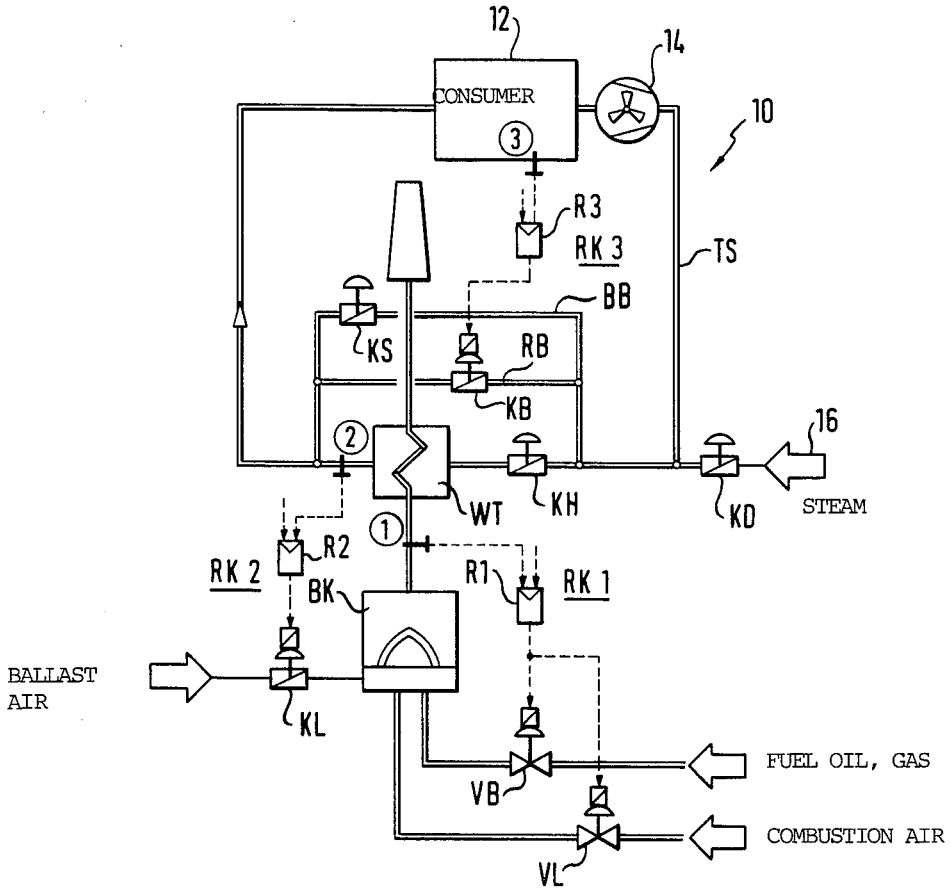
12
14
CONSUMER
10
3
R3
RK 3
TS
BB
KS
RB
KB
16
2
WT
KH
KD
STEAM
1
R2
RK 2
R1
RK 1
BK
BALLAST
AIR
KL
FUEL OIL, GAS
VB
COMBUSTION AIR
VL

APPARATUS FOR THE DRYING OF TOBACCO MATERIALS

BACKGROUND OF THE INVENTION

1. Field of the Invention

The invention relates to an apparatus for the drying of tobacco materials comprising an endless conveying system for circulating a mixture of hot gases and steam entraining the tobacco materials.

Such drying apparatus, also known as stream or pneumatic dryers, are used in the preparation of tobacco, the pourable material to be dried being conveyed pneumatically with the aid of a stream of hot gas and steam through a pipe (the consumer apparatus) and in so doing dried. The material to be dried is introduced with special feed devices into the circulated hot gas and steam flow and, after drying, separated again from the stream of hot gas and steam.

The advantages of such a stream dryer reside in the simple construction, high output with a small base surface, and simultaneous pneumatic conveying of the material to be dried.

2. Description of the Prior Art

An apparatus, developed for the tobacco industry, for the drying of cut tobacco materials of the kind specified is known from German laid-open specification 2 841 874, and comprises an endless conveying line or system, namely a conduit system, for the circulating of a mixture of hot gas and steam, a device for feeding the material to be dried into the conveying system, a separator for the dried material, a heat source for the mixture of hot gas and steam in the conveying system, namely a heater, a control bypass bypassing the heat source and with an adjustable throughflow quantity for temperature regulation, and also a device for introducing steam into the conveying system.

This apparatus has the following disadvantage. Stream dryers of this kind are generally operated batchwise i.e. in the first instance a specific batch is put through, this being based on a precisely defined tobacco mixture. When the tobacco mixture is to be changed, which happens several times a day in some production plants, the entire dryer has to be shut off, and it cools down to an extent corresponding to the length of the pause in operations, so that a starting-up period is necessary each time. The cooling and the subsequent starting with heating-up to the operating temperature result in such stream dryers having a considerable energy consumption, and disturb the overall production runs (unnecessary delays due to having starting-up times).

SUMMARY OF THE INVENTION

Therefore, the invention has as its object to provide a stream dryer of the kind specified wherein the aforesaid disadvantages do not occur.

More particularly the invention aims at providing a stream dryer of the kind specified with which, when there is a change in the material to be dried, for example when changing to another tobacco mixture composition, it is no longer necessary to have a complete interruption of work with subsequent re-starting.

Accordingly the invention provides an apparatus for the drying of tobacco materials of the specified kind comprising a second, ready-use bypass bypassing the heat source and in parallel with the first control bypass, a first shut off element for the steam supply, a second shutoff element in the conveying system upstream or downstream of the heat source, and a third shutoff element in the ready-use bypass.

Advantageous constructional forms are grouped in the subordinate claims.

The advantages achieved with the invention stem from the following method of operation : besides the control bypass for temperature control which is also provided in a conventional stream dryer there is used a second, parallel ready-use bypass, which also circumvents the heat source. In the case of day or week shifts the stream dryer is started in the usual way and brought to its operating temperature, and the mixture of hot gas and steam is circulated and the material to be dried is fed in.

Now, if the material to be dried is to be changed, for example if another tobacco mixture is to be passed through, it is no longer the case that the entire stream dryer is taken out of operation, and instead there is simply interruption of steam infeed and of the flow of the mixture of hot gas and steam through the heat source. There is then substantially only a flow of hot gas through the ready-use bypass, and the heat loss is compensated for by suitable measures. In this state of readiness the control bypass operates in the usual way i.e. about 10% of the hot gas flows through the control bypass, and as a result a specific temperature can be maintained in the conveying system.

Conveniently the heat source, for examle a heat exchanger, is used for supplying heat in the state of readiness as well; for this purpose the shutoff element provided in the conveying system should have two specific positions, namely on the one hand a completely opened position and on the other hand a position with a relatively small throughflow quantity, so that a small flow still passes through the heat exchanger, and the heat loss is thereby compensated.

In this state of readiness, which is also known as a "standby state", the conveying system and the hot gas are approximately at production temperature, so that from this state of readiness the stream dryer can be brought back in a short space of time to the normal operating state.

For switching over from the state of readiness to actual production the shutoff element in the ready-use bypass is closed, the steam supply is opened again, and the path of flow through the heat source is also made available again, so that the mixture of hot gas and steam which is now available is, in a very short space of time, brought to a temperature which is above the actual operating temperature. Then if the mass of material to be dried is fed suddenly into this stream dryer, because of the heat sink which is produced as a result there is a drop in the temperature in the system, and by suitable adjustment between the flow temperature, the introduced mass of material and the operating temperature it is possible to achieve the result that the lowered temperature value is approximately equal to the production temperature.

It is advantageous to use as the heat source a shell-and-tubes heat exchanger, to which hot gas is fed from a fuel oil burner. The mixture of hot gas and steam flows in cross or counter-current flow through the heat exchanger. Long-term changes in the final moisture of the material are regulated-out by means of the burner, in other words the supply of fuel oil in the case of a fuel oil burner, and short-term variations are regulated-out by means of the control bypass. Detailed Description of the Preferred Embodiment The invention is discussed in more detail hereinafter with the use of a constructional example and with reference to the accompanying diagrammatic drawing, the single FIGURE of which shows a diagram of the basic layout of a stream dryer according to the invention.

This stream dryer, which is indicated by the general reference numeral 10, comprises an endless conveying system TS formed for example of a closed conduit system. Through this conveying system a mixture of hot gas and steam flows in the arrowed direction, in other words in the clockwise direction.

In this stream dryer 10 the consumer apparatus is shown schematically at 12, namely the part of the conveying system TS at which the materials to be dried, for example cut tobacco materials, are added to the flow of hot gas and steam mixture, entrained by the said flow, dried as they are so carried along, and finally separated again from the flow.

The feeding and the separating-out of the goods being dried are effected in the usual way, so that they do not need to be explained in detail.

A radial-flow fan 14 is provided in the conveying system TS for circulating the mixture of hot gas and steam in the conveying system TS.

The steam is introduced into the stream dryer 10 through a steam inlet 16 which can be closed by a shutoff element KD.

Through an inlet which is not particularly referenced the hot gas may also be supplemented and/or exchanged when necessary.

The mixture of hot gas and steam circulated by the radial-flow fan 14 flows past the steam inlet 16 through the conveying system TS and passes by way of a shutoff element KH for the hot gas and steam flow to a shell-and-tubes heat exchanger WT and then to the inlet of the consumer apparatus 12.

In the heat exchanger WT the mixture of hot gas and steam in the conveying system TS is heated by the hot exhaust gases of a burner BK for fossil fuels, such as for example fuel oil or gas. This burner BK is of conventional construction and receives not only the fossil fuel, in other words oil or gas, but also combustion air in the desired ratio. Ballast air is also supplied to the burner BK, to allow temperature adjustment.

The hot exhaust gases of the burner BK flow through the heat exchanger WT, and in so doing heat the circulated hot gas and steam mixture in the conveying system TS which flows in counter-current or cross flow through the heat exchanger WT.

The conveying system TS has a first control bypass RB which bypasses the heat exchanger WT and through which in general approximately 10% of the total circulated hot gas and steam mixture flows. In parallel with this control bypass RB is a ready-use bypass BB, which also bypasses the heat exchanger WT and which is provided with a shutoff element KS.

This stream dryer comprises the three conventional automatic control systems RK, namely a control system RK1 which at the measuring point 1 detects the temperature of the exhaust gases of the burner BK and via a control unit R1 acts on a regulating or final control element VB which regulates the quantity of fuel fed to the burner BK in accordance with the temperature of the exhaust gases.

The control unit R1 also acts on a final control element VL for the quantity of combustion air which is fed to the burner.

A second measuring point 2 ascertains the temperature of the conveying system TS downstream of the heat exchanger as considered in the direction of flow, and by means of a second control system RK 2 with a control unit R2 and a final control element KL regulates the quantity of ballast air supplied to the burner BK.

Finally a third control system RK 3 ascertains at the measuring point 3 the temperature at the consumer apparatus, i.e. the temperature of the mixture of hot gas, steam and material to be dried on the drying section proper, and by way of a control unit R3 influences a third final control element KB in the control bypass RB; this final control element KB regulates the throughflow quantity in the control bypass RB in dependence on the temperature at the consumer apparatus 12, so that the short-term fluctuations in the operating temperature can be compensated.

When starting this stream dryer 10 the shutoff element KD of the steam inlet 16 remains closed, so that the circulated hot gas is heated only by means of the heat exchanger WT. When the operating temperature is reached, which is detected at the measuring point 3, the starting operation is concluded, i.e. the whole of the hot gas present in the conveying system TS is at the operating temperature. Generally less than an hour is needed for the attainment of this state of readiness.

After the state of readiness has been reached, the shutoff element KH is closed, so that only a relatively small gas quantity flows now through the heat exchanger WT; at the same time the shutoff element KS in the ready-use bypass BB is opened. The shutoff element KD of the steam inlet 16 is still closed.

Thus in this state of readiness the hot gas flows substantially through the ready-use bypass BB, and the surface and exhaust gas losses are compensated in the usual way by means of the control bypass RB and the quantity of hot gas flowing through the heat exchanger WT.

Thus in this state of readiness the three control systems RK1, RK2 and RK3 operate in the usual way, so that the hot gas has a temperature which corresponds substantially to the operating temperature.

This state of readiness is a waiting position, from which the stream dryer 10 can be changed over to production operation in a very short time.

As soon as production is to be begun, starting from the state of readiness, the ready-use bypass BB is closed by closing the shutoff element KS, and the shutoff element KH is opened, so that all the hot gas flows through the heat exchanger WT. Also the shutoff element KD of the steam inlet 16 is opened, whereby the temperature of the entry chamber for the material to be dried at the consumer apparatus 10 goes to the production value, for example to a temperature value of 350° C. in the case of drying cut tobacco materials.

Then, after a period of time which can be determined by a few experiments, the whole of the material for drying is fed to the consumer apparatus 12, so that the heat sink produced thereat results in a fall in temperature. If the instant of introduction for the material to be dried and the flow temperature have been correctly chosen, the production temperature drops to into the vicinity of the value which it has in the static state during production.

Further regulation of temperature is effected in the conventional way by means of the control system RK3 and the control bypass RB.

If it becomes necessary to change the material which is to be dried, i.e. for example if another tobacco mixture is to be dried, the shutoff element KD for the steam inlet 16 is completely closed and the shutoff element KH for the heat exchanger WT is closed to a considerable extent and the shutoff element KS in the ready-use bypass BB is openend. Thus only hot gas is now circulated, and it is kept at production temperature through the control bypass RB and the heat exchanger WT in the usual way. Then, starting from this situation, actual production can be re-commenced within a short time.

When there are production interruptions, for example because of faults, rest times and changing the tobacco mixture, if these are shorter than the cold start time the stream dryer 10 is brought to the state of readiness. Hence it is no longer necessary to switch off the stream dryer 10 as has hitherto been required, for example when the mixture is changed.

What is claimed is:

1. An apparatus for the drying of tobacco materials comprising:

(a) an endless conveying system for circulating a mixture of hot gas and steam;

(b) a consumer apparatus in said conveying system which includes (1) means for feeding and entraining tobacco materials to be dried into the circulating mixture of hot gas and steam, and (2) means for separating the dried tobacco materials from the circulating mixture of hot gas and steam;

(c) a heat source in said conveying system, (d) a first control bypass connected to said conveying system bypassing around said heat source and having means for adjusting throughflow quantity for regulating temperature of the circulating mixture of hot gas and steam;

(e) means for feeding steam to said conveying system including a first shutoff element;

(f) a second, ready-use, full-flow bypass connected to said conveying system around said heat source in parallel to said first control bypass;

(g) a second shutoff element positioned in said conveying system between said heat source and said first and second bypasses;

(h) a third shutoff element positioned in said second bypass; and (i) means operatively connected to said second and third shutoff elements for controlling flow of the circulating mixture of hot gas and steam such that the mixture either substantially completely flows through said heat source or substantially completely flows through said second bypass bypassing said heat source.

2. An apparatus according to claim 1 wherein the heat source is a heat exchanger operating in countercurrent.

3. An apparatus according to claim 2 wherein the heat source is a shell-and-tubes heat exchanger.

4. An apparatus according to one of claims 2 or 3 wherein the second shutoff element is situated at the onflow side of the heat exchanger between the bypasses.

5. An apparatus according to claim 2 wherein the second shutoff element has two positions, which are a completely opened position and a position with slight throughflow.

6. An apparatus according to one of claims 2 or 3 wherein the second shutoff element is situated at the offlowside of the heat exchanger between the bypasses.

7. An apparatus according to claim 6, wherein the second shutoff element has two positions which are a completely opened position and a position with slight throughflow.

8. An apparatus according to claim 1, wherein the heat source is a heat exchanger operating in cross-flow.

9. An apparatus according to claim 8 wherein the heat source is a shell-and-tubes heat exchanger.

10. An apparatus according to one of claims 8 or 9 wherein the second shutoff element is situated at the offlow side of the heat exchanger between the bypasses.

11. An apparatus according to one of claims 8 or 9 wherein the second shutoff element is situated at the onflow side of the heat exchanger between the bypasses.

12. An apparatus according to claim 1, wherein the second shutoff element has two positions which are a completely opened position and a position with slight throughflow.

13. An apparatus according to claim 10, wherein the second shutoff element has two positions which are a completely opened position and a position with slight throughflow.

14. An apparatus according to claim 11, wherein the second shutoff element has two positions which are a completely opened position and a position with slight throughflow.

15. An apparatus according to claim 4, wherein the second shutoff element has two positions which are a completely opened position and a position with slight throughflow.

* * * * *